US009845798B2

(12) United States Patent
Miguel et al.

(10) Patent No.: US 9,845,798 B2
(45) Date of Patent: Dec. 19, 2017

(54) SUSPENSION FOR HERMETIC RECIPROCATING COMPRESSOR FOR MOBILE APPLICATIONS AND METHOD OF ASSEMBLY OF THE SUSPENSION FOR HERMETIC RECIPROCATING COMPRESSOR FOR MOBILE APPLICATION

(71) Applicant: Whirlpool S.A., São Paulo-SP (BR)

(72) Inventors: Edson Correa Miguel, Joinville (BR); Patrick Getnerski, Joinville (BR)

(73) Assignee: Whirlpool S.A., Sao Paulo (BR)

( * ) Notice: Subject to any disclaimer, the term of this patent is extended or adjusted under 35 U.S.C. 154(b) by 0 days.

(21) Appl. No.: 14/909,358

(22) PCT Filed: Jul. 30, 2014

(86) PCT No.: PCT/BR2014/000261
§ 371 (c)(1),
(2) Date: Feb. 1, 2016

(87) PCT Pub. No.: WO2015/013793
PCT Pub. Date: Feb. 5, 2015

(65) Prior Publication Data

US 2016/0195079 A1 Jul. 7, 2016

(30) Foreign Application Priority Data

Aug. 1, 2013 (BR) ..... 1020130196711

(51) Int. Cl.
*F16F 1/06* (2006.01)
*F04B 39/00* (2006.01)
(Continued)

(52) U.S. Cl.
CPC ..... *F04B 39/0044* (2013.01); *F04B 39/0027* (2013.01); *F04B 39/06* (2013.01); *F04B 39/121* (2013.01); *F04B 39/127* (2013.01)

(58) Field of Classification Search
CPC .. F04B 39/0044; F04B 39/0238; F04C 29/04; F04C 29/12; B60G 7/04; B60G 11/16
(Continued)

(56) References Cited

U.S. PATENT DOCUMENTS 2,596,780 A * 5/1952 Meyers ..... B60G 7/04 16/86 A
2,932,474 A 4/1960 Becker et al.
(Continued)

FOREIGN PATENT DOCUMENTS

GB 540260 A 10/1941
JP 2010229833 A 10/2010
(Continued)

OTHER PUBLICATIONS

International Search Report dated Jan. 8, 2015 in counterpart International Patent Application No. PCT/BR2014/000261, filed Jul. 30, 2014.

*Primary Examiner* — Christopher Schwartz
(74) *Attorney, Agent, or Firm* — Harrington & Smith

(57) ABSTRACT

The present invention relates to a suspension disposed between a compression unit and the hermetic housing of hermetic reciprocating compressors for mobile application, such as, for example, application in automotive vehicles and similar, and to the method of assembly of the components that constitute the referred suspension. According to the present invention, it is disclosed a suspension for hermetic reciprocating compressor for mobile application capable of reducing the effects of an eventual and involuntary sudden movement of the compression unit and also of minimizing the transfer of vibrations and noises deriving from the environment outside the hermetic housing to the compression unit.

3 Claims, 2 Drawing Sheets

(51) Int. Cl.
*F04B 39/06* (2006.01)
*F04B 39/12* (2006.01)

(58) Field of Classification Search
USPC ..... 267/139, 140, 152, 153, 169, 174, 178, 267/179; 417/360, 363
See application file for complete search history.

(56) References Cited

U.S. PATENT DOCUMENTS

| | | | | | |
|---|---|---|---|---|---|
| 4,108,581 | A * | 8/1978 | Miller | F04B 39/127 | 417/363 |
| 5,342,179 | A * | 8/1994 | Dreiman | F04B 39/127 | 417/363 |
| 5,419,539 | A * | 5/1995 | Bressler | B60G 7/04 | 267/140 |
| 5,823,518 | A * | 10/1998 | Nagamitsu | F16F 1/122 | 267/169 |
| 6,004,113 | A * | 12/1999 | Vay | F04B 39/127 | 248/624 |
| 7,722,335 | B2 | 5/2010 | Kim | 417/417 | |
| 8,720,921 | B1 * | 5/2014 | Lamberti | B60G 11/38 | 267/153 |
| 2008/0290572 | A1 * | 11/2008 | Desprez | B60G 11/16 | 267/178 |
| 2012/0269661 | A1 * | 10/2012 | Maganhoto | F04B 39/127 | 417/410.1 |

FOREIGN PATENT DOCUMENTS

| | | | |
|---|---|---|---|
| KR | 10-2005-0052152 | A | 3/2002 |
| WO | 2011/050430 | A1 | 5/2011 |

* cited by examiner

SUSPENSION FOR HERMETIC RECIPROCATING COMPRESSOR FOR MOBILE APPLICATIONS AND METHOD OF ASSEMBLY OF THE SUSPENSION FOR HERMETIC RECIPROCATING COMPRESSOR FOR MOBILE APPLICATION

CROSS-REFERENCE TO RELATED APPLICATIONS

This application is a U.S. National Stage of International Patent Application No. PCT/BR2014/000261, filed on Jul. 30, 2014, which claims priority to Brazilian Patent Application No: 1020130196711, filed on Aug. 1, 2013. The disclosure of each of these applications are incorporated herein by reference in their entirety.

FIELD OF THE INVENTION

The present invention relates to a suspension for a hermetic reciprocating compressor for mobile application, more particularly to a suspension disposed between the compression unit and the hermetic housing of the hermetic reciprocating compressors for mobile application, such as, for example, application in automobiles and similar.

In contrast to most of the suspensions existing nowadays, the referred suspension for a hermetic reciprocating compressor for mobile application has the main function of acting when the compressor is turned off. Thus, the present suspension has the main object of preventing the transmission of vibrations from outside the housing to the compression unit, housed inside the hermetic housing.

The present invention relates also to an assembly method of the suspension for the hermetic reciprocating compressor for mobile application, and especially, to the assembly method of the components integrating the referred suspension.

BACKGROUND OF THE INVENTION

As it is well known by the technicians skilled in the art, hermetic reciprocating compressors comprise equipment able to compress a certain work fluid. Being applied normally in refrigeration systems, the hermetic reciprocating compressors are, therefore, able to compress any refrigerating fluid.

More particularly the compression of a work fluid, in a hermetic reciprocating compressor is brought about by the dynamic changes of volume of at least one pressure chamber, being such change in volume brought about by the reciprocating movement of a specific component inside the referred pressure chamber. Normally, the specific component able to reciprocate inside the pressure chamber is called a piston, and the pressure chamber is normally called compression cylinder.

In this sense, the reciprocating movement of the piston, inside the pressure chamber aligning to the synchronization of the valves of suction and discharge is able to draw the work fluid at reduced pressure, compress it and discharge it into any other system (normally, a refrigeration system) at high pressure.

In the specific case of reciprocating compressors, whether hermetic or not, the reciprocating movement of the piston is generated from the continuous movement of a rotating drive source, which is habitually comprised by an electric engine with a rotating shaft. To this end, the connection between the rotating shaft of the electric engine and the piston is brought about by a mechanical assembly comprised by an eccentric shaft and an extension rod (or connecting rod).

The eccentric shaft is coupled to the rotating shaft of the electric engine, and the extension rod is coupled both to the eccentric shaft and the piston. Thus, the rotation movement of the engine shaft is transformed into a reciprocating movement for the piston.

As it is also known to the technicians skilled in the art, the compression unit (integrated by the mobile elements of the compressor) for the hermetic reciprocating compressor is physically associated to the hermetic housing through the suspension structures.

The referred suspension structures of the compressors are always in technical development.

The reason for this is that the reciprocating movement of the piston, together with the movement of the rotating shaft of the electric engine, eventually generates vibrations and noises which should be, preferably, reduced before they reach the hermetic housing, and, therefore, the outside environment. Thus the technical evolution of the suspension structures of compressors is basically associated to the optimization of the reduction of vibration and noises.

In general, the suspensions of the compressors, independently of their type, are composed by two end stops and a semi-rigid or resilient element disposed between the referred end stops.

Normally, one of the end stops is anchored on the compression unit whereas the other end stop is anchored on the hermetic housing, the semi-rigid or resilient element being responsible for absorbing the vibrations and noises of the compression unit before they are spread to the hermetic housing.

The state of the art comprises a great variety of models of suspensions for compressors.

KR362853, for example, describes a suspension for a compressor composed by a pair of ball joints each one of which is fitted with a discoid projection and a cylindrical projection. In this realization, one of the ball joints is housed in a spherical cavity defined in the compression unity (in the compressor block) while the other ball joint is housed in a spherical cavity defined in the lower inside wall of the hermetic housing, the discoid and the cylindrical projections of both the joints facing each other. A spring is also provided between the referred ball joints, the ends of the referred spring being inserted between the said discoid and cylindrical projections. Apparently this kind of suspension allows, due to the ball joints, for a wider range of movements between the compression unit and the hermetic housing.

However, this kind of suspension—and the vast majority of compressor suspensions pertaining to the state of the art—has no provision of any type of protection of the end stops attached to the compression unit and to the hermetic housing (in this case, the ball joints), and if the compression unit undergoes an involuntary and sudden movement, common in mobile applications, there is a possibility that the said end stops bump into each other, reducing their lifetime. Therefore, the suspension described in KR362853—and the vast majority of compressor suspensions pertaining to the state of the art—do not present the fundamental conditions for the use of the hermetic reciprocating compressors for mobile application.

JP2010229833, for example describes a hermetic compressor that comprises suspension structures able to prevent the blocking of the spring disposed between the two end stops, besides reducing, theoretically, the level of the vibrations and noises between the compression unit and the hermetic housing with this end in view, the upper end stop (attached to the compression unit) is made up by a pin and a pin cover, the free end of the pin piercing the pin cover and projecting out and in the direction of the lower end stop (attached to the lower inside wall of the hermetic housing). Apparently, before the spring disposed between the two end stops is fully compressed (blocking state), the free end of the pin of the upper end stop contacts the top of the lower end stop.

However, this type of suspension does not provide any type of protection for the end stops attached to the compression unit and to the hermetic housing and, in the event of the compression unit presenting an involuntary and sudden movement, common in mobile applications there is a possibility of the said end stops bumping into each other, reducing their lifetime. Therefore, the suspension described in JP2010229833 does not present the fundamental conditions to make it able to be used in hermetic reciprocating compressors of mobile application.

KR200052152, for example, describes a compressor suspension especially destined to the absorption of eventual sudden shocks. To this end, the lower end stop (attached to the lower inside wall of the hermetic housing) is provided at the top with another spring. The referred spring has one end attached to the top of the lower end stop and the other free end facing the upper end stop. Thus, this kind of suspension, as opposed to the others, provides at least some protection for the end stops, for the case of a shock produced by the involuntary and sudden movements of the compression unit.

However, as it is known to the technicians skilled in the art, in mobile applications, the hermetic reciprocating compressors are also subject to small vibrations and noises its source related to the mobile application itself, as in automotive vehicles, for example. These small vibrations and noises, if not conveniently isolated, resonate inside the hermetic housing, being amplified to harmful and unpleasant levels.

Therefore, the suspension described in KR2005052152, although providing protection for the end stops, does not provide for any kind of absorption of small vibrations and noises between its body and the hermetic housing of the compressor, not providing, therefore, the essential conditions for its use in hermetic reciprocating compressors for mobile application.

U.S. Pat. No. 7,722,335, on the other side, describes a suspension specifically directed to linear compressors that, apparently, have means for the absorption of small vibrations and noises between its lower end stop and its housing but does not provide any kind of protection related to the eventual shock between the upper end stop and the lower end stop.

As has been described and claimed in U.S. Pat. No. 7,722,335, the suspension is integrated by an upper end stop (attached to the compression unit), by a lower end stop (attached to the lower inside wall of the hermetic housing) and a spring disposed between the two end stops.

The upper end stop has a simple construction, being defined by a monoblock body able do house one of the spring ends.

The lower end stop has a more complex construction, being defined by a pin, a tubular damping sleeve and an outside cover. The pin is directly attached to the housing leaving its top, in the form of a "T", totally free. The outside cover, intended to house the other spring end, has an annular structure with the outside profile essentially in the form of a truncated cone, while the inside profile is essentially cylindrical. A tubular damping sleeve disposed between the pin and the outside cover further defines a lower deformation to prevent the physical contact between the outside cover and the housing and an upper deformation to prevent the contact of the outside cover with the pin.

Therefore, and for all effects, the outside cover is physically isolated from the pin and from the housing. Consequently, small vibrations and noises (from an outside source) impacted on the compressor housing are absorbed by the tubular damping sleeve, before being led to the outside cover. However, if there is a sudden movement in the compression unit in relation to the housing (also coming from an inside source), it should be observed that the top of the upper end stop will bump against the pin of the lower end stop, damaging both components, and eventually, damaging the compressor housing itself.

Therefore, the suspension described in U.S. Pat. No. 7,722,335, though providing means for the absorption of small vibrations and noises, lacks the protection for the end stops, lacking, therefore, the essential conditions for its use in hermetic reciprocating compressors for mobile application.

The presence of the technical shortcomings of the state of the art described above gave rise to the present invention.

OBJECTIVES OF THE INVENTION

Therefore, based on all the shortcomings associated with the state of the art, one of the objectives of the present invention consists in describing a suspension for a hermetic reciprocating compressor for mobile application able to reduce the effects of an eventual and involuntary sudden movement of the compression unit and, at the same time reduce the transfer of vibrations and noises coming from the environment outside the hermetic housing to the compression unit.

In this way, it is one of the objectives of the present invention to describe a suspension for hermetic reciprocating compressors which would have the fundamental conditions for the referred hermetic reciprocating compressors to be used in non stationary applications and/or for mobile applications.

Therefore, one of objectives of the present inventions is for the lower end stop of the suspension for the hermetic reciprocating compressors for mobile application to comprise a pin without any type of possibility of contact with the upper end stop.

Finally, another objective of the present invention is to describe a method of assembly of the suspension for a hermetic reciprocating compressor for mobile application.

SUMMARY OF THE INVENTION

To this end, with the view of achieving the objectives and the technical effects given above, the present invention discloses a suspension for hermetic reciprocating compressors for mobile application, wherein the compressor comprises at least one reciprocating compression unit enclosed in a hermetic housing, comprising the referred suspension at least one upper end stop, at least one intermediate spring and at least one lower end stop.

According to the present invention, the referred upper end stop is associated with the reciprocating compression unit, while the lower end stop is associated with the hermetic housing, and the intermediate spring is disposed between the upper end stop and the lower end stop.

In general, the lower end stop comprises at least one anchoring structure, at least one damping structure and at least one upper cover, the said damping structure being concentrically disposed on the anchoring structure so as to cover it completely, and the said upper cover is concentrically disposed on the damping structure so as to cover is completely.

Preferably, the damping structure comprises a cylindrical body with a closed top, and an annular bottom edge. Also preferably, the upper cover comprises a body in the shape of a truncated cone with the top partially open and having a bottom annular edge. In this case, the bottom annular edge of the upper cover is disposed on the bottom annular edge of the damping structure.

Still according to the present invention, the damping structure is made from an elastomeric alloy, the upper cover is made from a polymeric alloy and the anchoring structure is made from a metallic alloy, and may also include a projection defined by the hermetic housing itself.

The objectives of the present invention, one way or the other, are intrinsic to the assembly of the lower end spot of the suspension for the hermetic reciprocating compressors for mobile application now disclosed. Thus, and according to the present invention, the referred assembly of the lower end stop comprises, at least, one step of attachment of the anchoring structure on the hermetic housing of the hermetic reciprocating compressor for mobile application, a step of insertion, by pressure, of the damping structure on the anchoring structure and a step of insertion by pressure of the upper cover on the damping structure.

In general, it can be observed that, during the insertion, by pressure, of the damping structure on the anchoring structure, the referred damping structure undergoes a physical elastic deformation, and during the insertion, by pressure of the upper cover on the damping structure, the referred damping structure undergoes a physical elastic deformation.

BRIEF DESCRIPTION OF THE FIGURES

The present invention patent is described in detail based on the figures below, wherein.

DESCRIPTION OF THE INVENTION

According to the schematic figures mentioned above, the preferred embodiment of the present invention will be described in details below. However, it should be clear that both the figures concerned, and the detailed description of the preferred embodiment are merely given as an example and do not limit the invention, since the suspension for hermetic reciprocating compressors for mobile application that are now being disclosed may have different details and structural and dimensional aspects, without leaving the scope of the protection aimed at.

Figure 1:
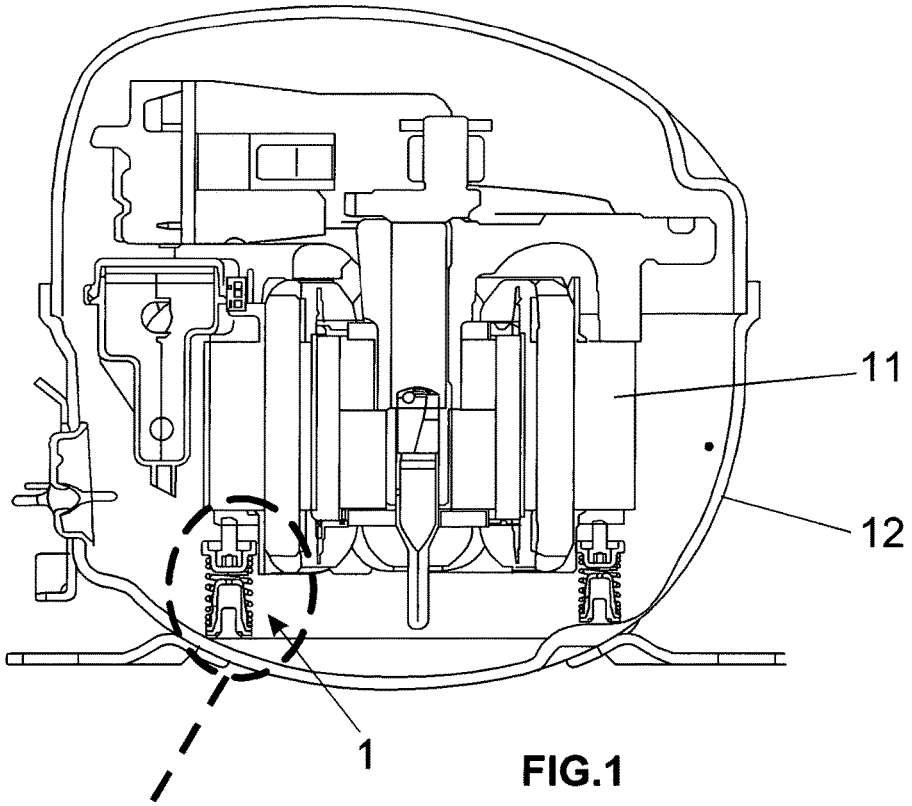
FIG. 1 shows a side view in section of an example of the hermetic reciprocating compressor for mobile application.

FIG. 1 shows in a schematic way a hermetic reciprocating compressor essentially conventional.

The referred compressor is basically composed by a compression unit 11 enclosed in a hermetic housing 12.

Preferably, the compression unit 11 mentioned is comprised by at least one electric engine, at least one compressor block, which defines the compression cylinder.

Besides, the referred compression unit 11 further provides a functional assembly characteristic of a hermetic reciprocating compressor, which has an assembly of piston-connecting rod-eccentric shaft, and an array of head-valves.

In general, in the case of the compression unit 11 being summed up, we are dealing with a conventional compression unit perfectly known by the technicians skilled in the art, and widely described and researched in the specialized literature. Consequently, the compression unit 11 of the hermetic reciprocating compressor does not constitute the subject matter of the present invention, but in the end defines its technological field.

Moreover the hermetic housing 12 mentioned is, preferably, essentially composed by two bodies able do be physically associated between themselves, defining a hermetic volume or chamber. It is also worth stressing that in the case of a hermetic housing 12 it is a conventional hermetic housing also fully known to the technicians skilled in the art and widely described and researched in the specialized literature.

As has been already mentioned, the compression unit 11 is housed inside the hermetic housing 12, the former supported inside the latter by means of suspensions 1. Preferably, four suspensions 1 are used to support a compression unit 11 inside the hermetic housing 12. Normally, each suspension 1 is attached to a point of the compressor bloc of the compression unit 11 and to a point on the lower inside wall of the hermetic housing 12.

As has already been described in detail, the generic use of suspensions between the compression unit and the hermetic housing, in hermetic reciprocating compressors, is also known to the technicians skilled in the art, and widely described and researched in the specialized literature.

Figure 2:
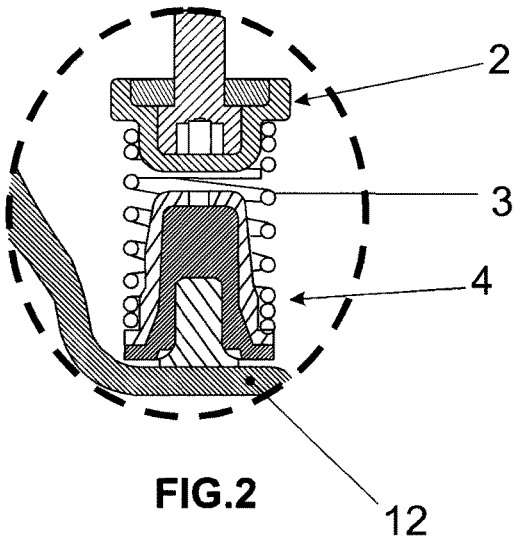
FIG. 2 shows an enlarged view of the suspension for the hermetic reciprocating compressor for mobile application taken from FIG. 1.
Figure 3:
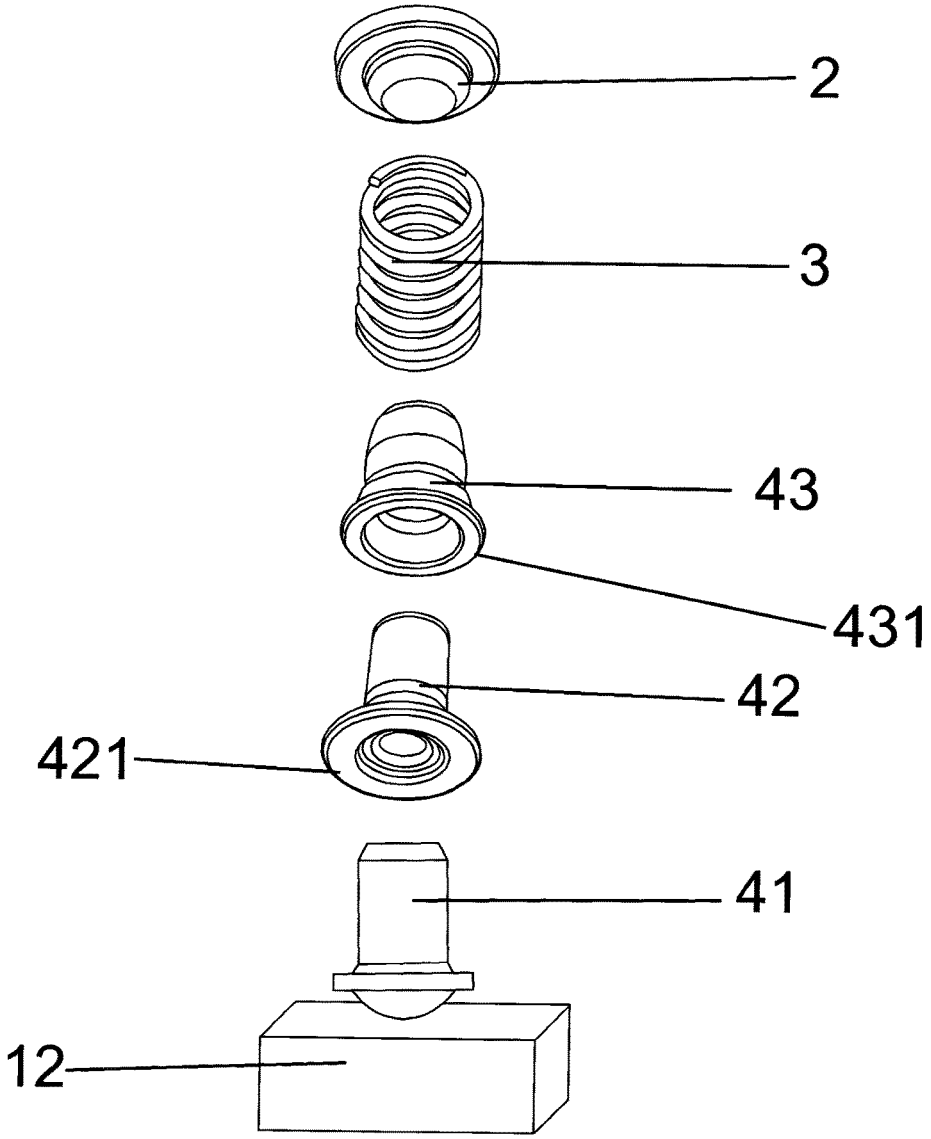
FIG. 3 shows an exploded perspective view of the suspension for the hermetic reciprocating compressor for mobile application.

According to the present invention, as referred to and illustrated in FIGS. 2 and 3, the suspension 1 mentioned comprises one upper end stop 2, one intermediate spring 3 and one lower end stop 4, the objective of the present invention referring exclusively to the said lower end stop 4.

Consequently, there is no limitation related to the upper end stop 2 and to the intermediate spring 3.

Preferably, but not as a limitation, the upper end stop 2 comprises in general a kind of cover composed by the annular edge and by a cover that projects from the said annular edge. As can be verified on FIG. 2, the upper end stop 2 is able to be physically associated to a portion of the compressor block of the compression unit 11.

Also preferably, the intermediate spring 3 is comprised by a helical spring with two partially blocked ends that are disposed in parallel. As can be verified on FIG. 2, one of the ends of the intermediate spring 3 is able to be housed/fitted into the upper end stop 2.

The lower end stop 4 in turn is basically comprised of an anchoring structure 41, of a damping structure 42 and of an upper cover 43.

The referred anchoring structure 41 is attached to a portion of the lower inside wall of the hermetic housing 12.

The damping structure 42 is disposed between the anchoring structure 41 and the upper cover 43.

The upper cover 43, therefore, is disposed on the damping structure 42 and receives on its upper face the other end of the intermediate spring 3.

More particularly, and according to the present invention, the damping structure 42 is concentrically disposed on the anchoring structure 41 so as to cover it completely, and the upper cover 43 is concentrically disposed on the damping structure 42 so as to cover is completely.

It is important to stress that the phrase "cover completely", refers to the act that an element covers the main faces of contact of the other element. However, and as is known to the technicians skilled in the art, mechanical aspects always involve the existence of gaps (voluntary and involuntary) and, thus, the phrase "cover completely" accepts the eventual occurrence of gaps between the elements mentioned above.

These are the two main features of the present invention. Therefore, these two characteristics are especially the ones that, when added up, reach the results and objectives of the present invention, these results and objectives never reached by similar suspensions existing nowadays and pertaining to the state of the art.

Thus it is worth reminding that the chief objectives of the present invention consist in describing a suspension for a hermetic reciprocating compressor especially used in mobile applications.

Consequently, the suspension now disclosed should, at least, be able to reduce the effects of an eventual and involuntary sudden movement of the compression unit and to be able to reduce the transfer of vibrations and noises arising from the environment outside the hermetic housing to the compression unit.

These two needs are fully met with the suspension 1 now being disclosed, and especially, with the lower end stop 4 being disclosed here.

When eventual and involuntary sudden movements of the compression unit occur, due to the mobile application of the hermetic reciprocating compressor, any shock between the upper end stop 2 and the lower end stop 4 is absorbed by the damping structure 42, which—since it covers completely the anchoring structure 41, isolating it from the upper cover 43—prevents greater physical damage to the suspension 1.

It is worth stressing that the suspension described in U.S. Pat. No. 7,722,335 fails in some points on this issue.

As to the vibrations and noises coming from the environment outside the hermetic housing 12, also due to the mobile application of the hermetic reciprocating compressor, the damping structure 42—since it is completely covered by the upper cover 43—is able to absorb them before they are led to the intermediate spring 3.

It is worth stressing that the suspension described in KR2005052152 fails in some points on this issue.

Thus, achieving at the same time those two technical results, the suspension 1 being now disclosed, and especially the lower end stop 4 have shown that it is capable of being used in hermetic reciprocating compressor for mobile application.

Moreover, it is worth observing the preferably, the damping structure 42 comprises a cylindrical body with the top closed, further comprising a bottom annular edge 421, as illustrated in detail on the FIG. 3. Moreover and also according to the detailed illustration on FIG. 3, the upper cover 43 consists in a body in the shape of a truncated cone with the top partially open, further comprising a bottom annular edge 431.

The complementary constructions allow for the bottom annular edge 431 of the upper cover 43 to be disposed on the bottom annular edge 421 of the damping structure 42, bringing more security and reliability to the lower end stop 4.

Preferably, and according to the preferred embodiment of the present invention, the damping structure 42 is built from an elastomeric alloy, having resilient proprieties. The upper cover 43 is built from a polymeric alloy and the anchoring structure 41 is built from a metallic alloy, and may, even comprise a projection defined by the hermetic housing 12 itself.

It is important to stress that the description above has the only objective of describing, as an example, a preferred embodiment of the present invention.

Therefore, it is clear that the suspension described in detail above may include some modifications, variations and combinations in construction which, since they have the same function, in substantially the same form, in order to achieve the same results, remain within the scope limited by the claims.

The present invention includes also a method of assembly of the suspension for hermetic reciprocating compressors for mobile application, and especially, the steps of the assembly of the lower end stop 4 of the suspension 1.

In general, those steps, which are in itself novel, comprise:

The attachment of the anchoring structure 41 to the hermetic housing 12 of the hermetic reciprocating compressor for mobile application;

The insertion, by pressure, of the damping structure 42 on the anchoring structure 41; and The insertion, by pressure, of upper cover 43 on the damping structure 42.

Those steps are, compared to the steps of the assembly of the suspension described in U.S. Pat. No. 7,722,335, substantially simpler and faster to be conducted.

In other words, those steps alone are enough for the assembly of the lower end stop 4 in the way it will be kept in the compressor, that is, no other optional steps are necessary besides those three simple steps. To this end, it should be observed, for example, that the steps of the assembly of the suspension described in U.S. Pat. No. 7,722,335 are finished by simply hitting the main pin of this suspension.

Preferably, but not as a limitation, the attachment of the anchoring structure 41 on the hermetic housing 12 may be made by welding.

Preferably, but not as a limitation, the insertion, by pressure, of the damping structure 42 on the anchoring structure 41 may be made by hand, or by appropriate machines, already commonplace in factory plants now in existence. It is important to stress that during the insertion, by pressure, of the damping structure 42, the referred damping structure 42 undergoes physical elastic deformation, but does not alter any condition of the anchoring structure 41 (as it does in U.S. Pat. No. 7,722,335).

Preferably, but not as a limitation, the insertion, by pressure of the upper cover 43 on the damping structure 42 may be done by hand, or by appropriate machines already commonplace in factory plants now in existence. It is important to stress that during the insertion, by pressure, of the upper cover 43 on the damping structure 42, the referred damping structure 42 undergoes physical elastic deformation.

The invention claimed is:

1. A suspension for hermetic reciprocating compressor for mobile application, the compressor comprising at least one reciprocating compression unit enclosed in a hermetic housing, the suspension comprising:

at least one upper end stop, at least one intermediate spring and at least one lower end stop;

the at least one upper end stop being associated with the at least one reciprocating compression unit, the at least one lower end stop being associated with the hermetic housing, and the at least one intermediate spring being disposed between the at least one upper end stop and the at least one lower end stop;

the at least one lower end stop comprising at least one anchoring structure, at least one damping structure and at least one upper cover;

wherein the at least one damping structure is concentrically disposed on the at least one anchoring structure so as to cover the at least one anchoring structure completely; and wherein the at least one upper cover is concentrically disposed on the at least one damping structure so as to cover the at least one damping structure completely;

wherein the at least one damping structure comprises a cylindrical body;

wherein the at least one damping structure further comprises a bottom annular edge;

wherein the at least one upper cover further comprises a bottom annular edge;

wherein the bottom annular edge of the at least one upper cover is disposed on the bottom annular edge of the at least one damping structure.

2. The suspension of claim 1 wherein the cylindrical body includes a closed top.

3. The suspension of claim 1 wherein the at least one upper cover comprises a truncated cone with a top partially open.

* * * * *